United States Patent [19]

Caflisch et al.

[11] Patent Number: 4,693,014

[45] Date of Patent: Sep. 15, 1987

[54] PHOTOSENSITIVE SHEET DRYER

[75] Inventors: Jerry A. Caflisch, Longmont, Colo.; John D. Ockuly, Blaine, Minn.

[73] Assignee: Pako Corporation, Minneapolis, Minn.

[21] Appl. No.: 910,787

[22] Filed: Sep. 23, 1986

Related U.S. Application Data

[63] Continuation of Ser. No. 762,114, Aug. 2, 1985, abandoned.

[51] Int. Cl.[4] ..... F26B 13/08; F26B 3/04

[52] U.S. Cl. ..... 34/23; 34/70; 34/155; 34/160

[58] Field of Search ..... 34/155, 160, 95, 70, 34/23

[56] References Cited

U.S. PATENT DOCUMENTS

| | | | |
|---|---|---|---|
| 3,863,360 | 2/1975 | Stievenar et al. | 34/151 |
| 4,117,604 | 10/1978 | Burg et al. | 34/95 |
| 4,139,953 | 2/1979 | Gaskell | 34/23 |
| 4,300,828 | 11/1981 | Kaufmann | 354/322 |
| 4,332,456 | 6/1982 | Kaufmann | 354/298 |

*Primary Examiner*—Larry I. Schwartz
*Attorney, Agent, or Firm*—Kinney & Lange

[57] ABSTRACT

A dryer apparatus for drying sheets of photosensitive material which eliminates reflective artifacts. The dryer apparatus includes a plurality of pairs of opposed drive rollers which support a sheet of photosensitive material in a generally planar sheet drying path. The pairs of opposed drive rollers are spaced longitudinally along the sheet drying path. The drive rollers are rotated to move the sheet in a first longitudinal direction along a path. A plurality of pairs of opposed dryer nozzles face the sheet drying path from each planar side thereof, with each pair of opposed dryer nozzles being between adjacent longitudinally spaced pairs of drive rollers. Each dryer nozzle includes a laterally disposed air inlet through which air is forced by a blower toward the sheet. A laterally extending guide is provided adjacent each roller for guiding the sheet along the sheet drying path. These guides create no obstruction to air flow between the air inlets of the dryer nozzles and the sheet of photosensitive material.

21 Claims, 5 Drawing Figures

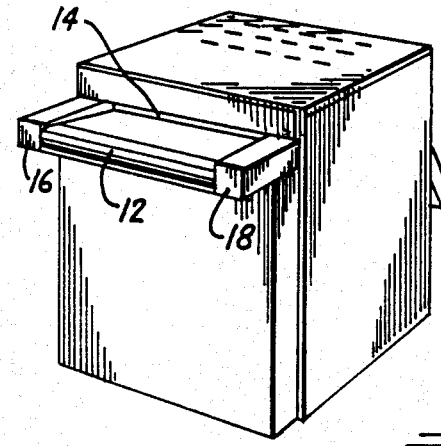
Fig. 1
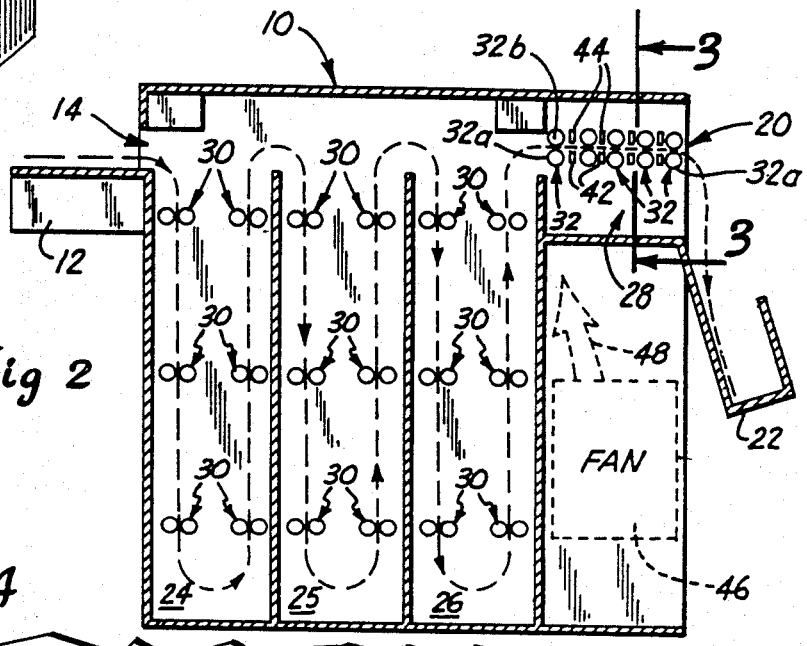
Fig 2
Fig. 4
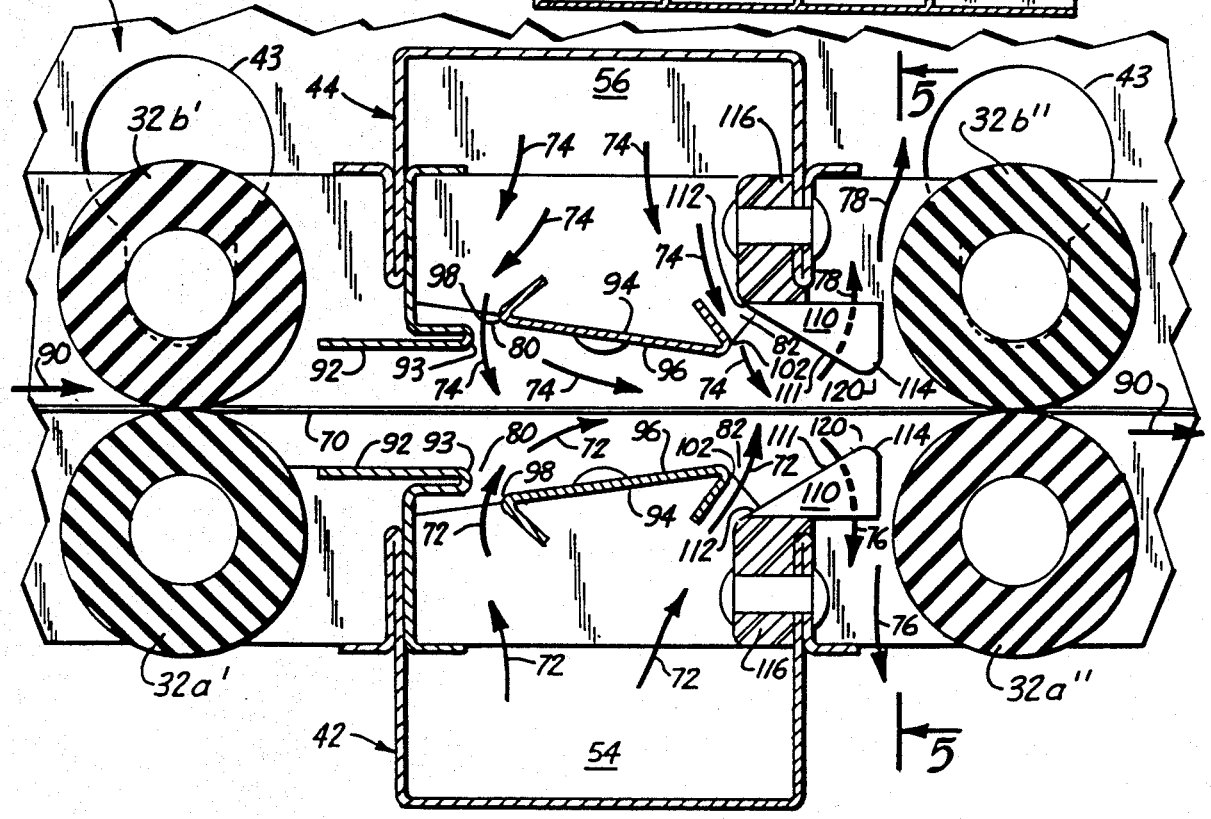

10
28
32
32a
32b
33
34
36
38
40
41
42
44
4
4
48
50
52
54
56
58
59
60
62
62
70
110
110

PHOTOSENSITIVE SHEET DRYER

This is a Continuation of application Ser. No. 762,114, filed Aug. 2, 1985 (now abandoned).

BACKGROUND OF THE INVENTION

1. Field of the Invention.

The present invention relates to dryers for photosensitive material, and specifically to a dryer apparatus which eliminates reflective artifacts.

2. Description of the Prior Art.

The processing of photosensitive materials typically require that the materials be saturated with various development chemicals. Once a sheet of photosensitive material has been exposed to such chemicals, it then must be dried uniformly for use in creating prints and copies of the images borne thereon.

Photosensitive material processors have been developed which feed a sheet of photosensitive material through the necessary chemicals in an orderly fashion and then dry the sheet for further use. Typically, this sheet is driven by engagement with various rollers to follow a desired processing path. Each sheet of photosensitive material will bear one or more unique photographic images, which are often incapable of being reproduced in exactly the same form. Thus, great care must be used in handling such sheets.

Prior art dryers for photosensitive material in sheet form have used various guides or supports to support the sheet as it passed from roller to roller. Air was blown at the sheet from blower outlets positioned between the rollers as it passed by to speed the drying process. Such guides or supports were found necessary in the dryer to keep the sheets of photosensitive material from being damaged by curling into the rollers or becoming misaligned. One method of supporting a sheet of photosensitive material between rollers was to provide a plurality of guide wires extending longitudinally along the sheet drying path (transversely to the rollers). Each roller was grooved to accommodate the wires passing by it.

A phenomena which existed in prior art processing and drying schemes was the creation of "reflective artifacts" (cosmetic blemishes) on the sheet of photosensitive material. Reflective artifacts can take the form of halos or lines which appear on the sheet, but which do onto affect the ultimate print made from that sheet of photosensitive material. Reflective artifacts detract from the appearance of the sheet of photosensitive material during processing and have resulted in dissatisfaction and resistence by users of such processing machines.

Reflective artifacts are apparently caused by disturbances in air flow patterns between the dryer inlets and the sheet of photosensitive material being dried. In prior dryers, these disturbances were caused by the various guides or supports (e.g., guide wires) which extended between rollers and created air flow turbulance between the sheet of photosensitive material and the blower inlets.

SUMMARY OF THE INVENTION

The dryer apparatus for drying sheets of photosensitive material of the present invention is designed to eliminate the problem of reflective artifacts. This is achieved by removing all obstructions to air flow between the air inlets of the dryer and the sheet of photosensitive material as it passes such air inlets.

The dryer apparatus of the present invention includes a plurality of pairs of opposed drive rollers for supporting the sheet of photosensitive material in a generally planar sheet drying path. Each pair of opposed drive rollers is spaced longitudinally along the sheet drying path and means are provided for selectively rotating the drive rollers to move the sheet of photosensitive material in a first longitudinal direction along the sheet drying path. A plurality of pairs of opposed dryer nozzles face the sheet drying path from each planar side thereof. Each pair of opposed dryer nozzles is positioned between adjacent longitudinally spaced pairs of drive rollers. Each dryer nozzle includes a laterally disposed air inlet. Air is blown through the air inlet of each dryer nozzle toward the sheet of photosensitive material by suitable blower means. Guide means are provided for guiding the sheet of photosensitive material along the sheet drying path and toward each pair of drive rollers. Each guide means is designed to create no obstruction to air flow between the air inlets of the dryer nozzles and the sheet of photosensitive material in the sheet drying path.

Each dryer nozzle has an air outlet which is downstream (relative to the first longitudinal direction of movement of the sheet of photosensitive material along the sheet drying path) from the air inlet of said dryer nozzle. The sheet of photosensitive material is engaged and guided by the guide means only adjacent the air outlet of each dryer nozzle, which is proximate a next downstream drive roller.

In a preferred embodiment, the guide means comprises a plurality of generally parallel longitudinally extending fingers spaced across a portion of each dryer nozzle. Each finger has a first end and a second end with the first end being upstream (relative to the first longitudinal direction of movement of the sheet of photosensitive material along a sheet drying path) from the second end thereof. Each finger defines a sheet guide ramp with its upstream end further from the sheet dryer path than its downstream end.

Preferably, each air inlet is a lateral air inlet slot in its respective dryer nozzle. A first lateral edge of each air inlet slot is closer to the sheet drying path than the second lateral edge of that air inlet slot, with the first end of the slot being upstream from the second end of said slot. In this embodiment, the dryer nozzles has first and second air inlet slots which are generally parallel and laterally disposed relative to the sheet drying path. Baffle means are provided between the first and second air inlet slots, with the baffle means having a generally planar, smooth surface facing the sheet drying path. A first lateral edge of the surface defines the second edge of the first air inlet slot and a second lateral edge of the surface defines the first edge of the second air inlet slot. The surface of the baffle means is preferably inclined with its first edge further from the sheet drying path than its second edge.

BRIEF DESCRIPTION OF THE DRAWINGS

FIG. 1 is a prospective view of a graphic arts processor utilizing the dryer apparatus of the present invention.

FIG. 2 is a schematic sectional side view of the graphic arts processor of FIG. 1.

FIG. 4 is a sectional view as taken along lines 4—4 in FIG. 3.

DETAILED DESCRIPTION OF THE PREFERRED EMBODIMENTS

Figures 3, 5:
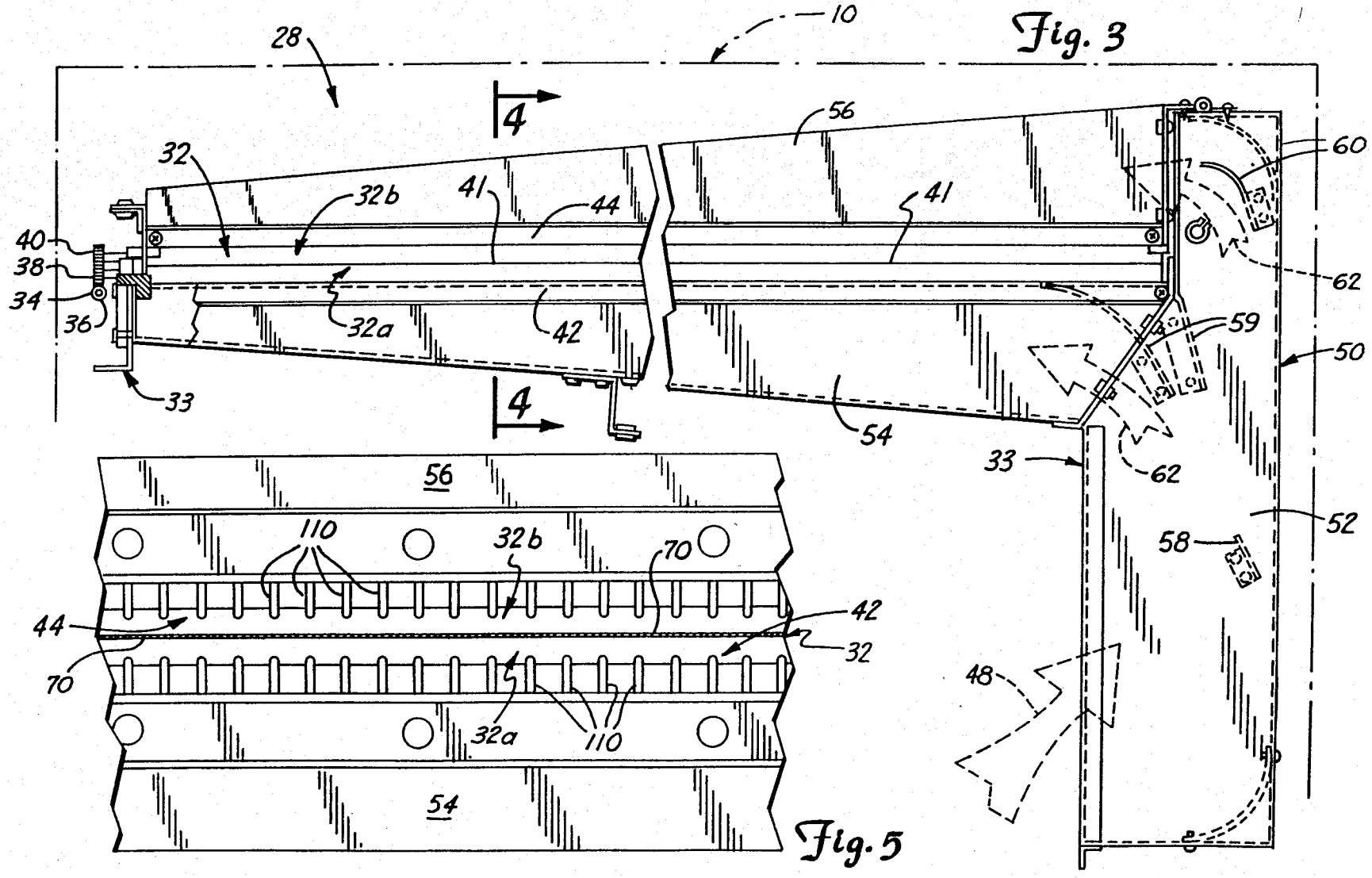
FIG. 3 is a sectional view taken generally along lines 3—3 in FIG. 2 showing an interior portion of the dryer apparatus of the present invention with some parts broken away and shown in section.
FIG. 5 is a sectional view as taken along lines 5—5 in FIG. 4.

FIG. 1 shows a graphic arts processor 10 which utilizes the present invention. At its front end, the processor 10 has a feed table 12 on which sheets of photosensitive material are fed into the processor through entrance opening 14. Positioned on opposite sides of the feed table 12 are left and right control pods 16 and 18, respectively. In a preferred embodiment of the present invention, left control pod 16 includes various manually operated switches, including a power switch for turning on the processor, a wait light and a feed annunciator. Both the wait light and feed annunciator indicate to the operator when another sheet of photosensitive material can be fed into the entrance opening 14.

Right control pod 18 preferably includes a keyboard and push-button switches, together with a display. The keyboard, switches and display are used for entering control information such as replenishment rates, transport speeds, temperatures and the like, and for selecting one of various combinations of processing control perimeters for use with a particular type of photosensitive sheet material. The front end of processor 10, including the feed table 12, the entrance opening 14 and left and right control pod 16 and 18, is located in a dark room to avoid exposure of the sheets of photosensitive material being fed into the processor.

The remaining portion of the processor 10 is preferably located on the opposite side of a wall (not shown) from the front end of the processor 10. The remainder of the processor 10 does not have to be maintained in darkness, and the room in which the remainder of the processor 10 is located is preferably a "light room" rather than a "dark room."

Sheets which have entered into entrance opening 14 are transported through the processor 10, and are eventually driven out of a rear end thereof through an exit opening 20 (shown in FIG. 2) and into a catch tray or basket 22.

In FIG. 2, a photosensitive sheet processing path is shown as passing between a plurality of roller pairs located in processing liquid tanks 24, 25, 26 and dryer portion 28 of the processor 10. These roller pairs form a transport system for transporting the sheet through the processor 10. The roller pairs for the tanks 24, 25 and 26 are designated generally by reference numeral 30, while the roller pairs for the dryer portion 28 are designated generally by reference numeral 32. The roller pairs 30 and 32 are rotatably mounted with respect to a structural support housing 33 of the processor 10 which is partially shown in FIG. 3. In preferred embodiments of the present invention, the roller pairs 30 and 32 are driven by common drive means, which may take a variety of well-known forms.

In FIG. 3, a portion of the drive means is shown. A drive shaft 34 has worm gear 36 thereon which engages a first gear 38 shafted on an end of a lower roller **32*a* of one of the dryer portion roller pairs 32. A second gear 40 is shafted to an end of an upper roller 32*b* of that dryer portion roller pair 32 and is driven by coupled engagement with the first gear 38 (upper roller 32*b* is aligned over lower roller 32*a* so the rollers define one of the dryer portion roller pairs 32). The drive shaft 34 is rotated by suitable drive means (not shown), such as an electric motor, to rotate its worm gear 36 and in turn, the coupled gears 38 and 40 of the rollers 32*a* and 32*b* of each roller pair 32. The roller pairs 30** are similarly driven.

In the dryer portion 28, the roller pairs 32 are aligned and spaced apart to convey the sheets of photosensitive material in a generally planar sheet drying path through the dryer portion 28. As seen in FIGS. 2 and 3, the roller pairs 32 are spaced along the planar sheet drying path, with a lateral line of engagement 41 of opposed upper and lower rollers **32*a* and 32*b* of each roller pair 32 thereby defining the sheet drying path. The lower roller 32*a* is mounted to rotate on a fixedly generally horizontal axis, while ends of the upper roller 32*b* are received in generally vertical slots 43 of the structural support housing 33 to permit the upper roller 32*b* to lay against the lower roller 32*a* along lateral engagement line 41. A sheet of photosensitive material 70 moves longitudinally (from left to right as viewed in FIG. 4) through the dryer portion 28, with the direction of movement of the sheet 70 illustrated by arrows 90 in FIG. 4. The sheet 70 is moved "upstream" (to the right as seen in FIGS. 2 and 4) along the sheet drying path by engagement with the rotating rollers 32*a* and 32*b***.

Between longitudinally spaced roller pairs 32 in the dryer portion 38 are a plurality of opposed lower and upper dryer nozzles 42 and 44. Air for drying the sheets of photosensitive material is directed to and out of the upper and lower dryer nozzles 42 and 44 by a fan 46 in the processor 10. Air is blown by the fan 46 to the dryer portion 28 generally as shown by arrows 48 in FIGS. 2 and 3 and into a dryer ductwork arrangement 50. The ductwork arrangement 50 includes a vertical duct 52 extending longitudinally along one side of the dryer portion 28. Air blown upward by the fan 46 through the vertical duct 52 is then directed into a plurality of lateral lower and upper ducts 54 and 56. Deflectors 58, 59 and 60 aid in directing the blown air in a uniform manner from the vertical duct 52 into the lower and upper ducts 54 and 56, as indicated by arrows 62 in FIG. 3.

Each opposed pair of lower and upper lateral ducts 54 and 56 extends laterally across the entire sheet drying path in the dryer portion 28 to feed air to the lower and upper dryer nozzles 42 and 44, respectively. Air from the ducts is thus blown onto the entire top and bottom surfaces of a photosensitive sheet passing between the two opposed ducts 54 and 56. As seen in FIG. 4, air in the lower duct 54 blow through the lower dryer nozzle 42 toward a sheet of photosensitive material 70 in the sheet drying path. This air flow is generally illustrated in arrows 72. Similarly, air in the upper duct 56 is blown through the upper dryer nozzle 44 toward the sheet of photosensitive material 70. This air flow is illustrated generally by arrows 74 in FIG. 4.

Between each spaced pair of rollers 32 in dryer portion 28, air is thus blown toward the sheet 70 from the dryer nozzles 42 and 44 of the opposed ducts 54 and 56. Preferably, the upper and lower dryer nozzles 42 and 44 are formed, with respect to the sheet drying path, as mirror images of one another (see FIG. 4).

After the air passes the sheet 70, it is directed away from the sheet 70 to escape or be recycled, as indicated generally by arrows 76 and 78 in FIG. 4. Air is thus directed across the entire top and bottom lateral surfaces of each sheet 70 as it passes through the dryer portion 28. As can be seen, there are no air flow obstructions between the upper and lower dryer nozzles 42 and 44 and the sheet of photosensitive material 70. Because there are no obstructions extending between adjacent roller pairs 32 under or over the sheet 70 to support it (and which might pass between the sheet 70 and dryer nozzles 42 or 44), air turbulence is minimized or eliminated and no reflective artifacts are formed on the sheet 70 as it is dried by the processor 10. An attempt to achieve this end by simply placing the roller pairs closer together longitudinally results in a design which limits dryer airflow because of the proximity of roller pairs along the sheet drying path. The ability to dry sheets of photosensitive material without creating reflective artifacts is thus achieved by the unique configuration of the upper and lower dryer nozzles 42 and 44 and their relationship to the longitudinally spaced roller pairs 32.

Specifically, each dryer nozzles has a pair of laterally disposed, generally parallel first and second air inlets 80 and 82 (for either upper or lower dryer nozzles 42 or 44). Air from the duct feeding the particular dryer nozzle is blown through the first air inlet 80 and second air inlet 82 as indicated by arrows 72 and 74 in FIG. 4. The air inlets 80 and 82 are slots that extend laterally across the sheet drying path so that air passing therethrough will be blown onto the entire lateral top and bottom surfaces of the sheet of photosensitive material 70. As seen in FIG. 3, the ducts 54 and 56 are tapered to be smaller as they extend farther from the vertical duct 52, in order to achieve a uniform pressurization and dispersal of the air across the lateral face of the sheet 70.

As a sheet 70 is fed by the roller pairs 32 upstream (in direction to arrow 90 in FIG. 4) and passes between each spaced pair of rollers 32 (such as rollers 32*a*′ and 32*b*′ in FIG. 4), the first portion of a dryer nozzle which the sheet's leading edge encounters is a lateral plate 92. The lateral plate (which is formed the same for either upper or lower dryer nozzles 42 and 44) extends laterally across and is slightly spaced from the entire sheet drying path. The lateral plate 92 extends from a point closely spaced from that roller pair 32 which the sheet 70 just passed through (the rollers 32*a*′ and 32*b*′ to the left in FIG. 4) to a point where a downstream edge of the lateral plate 92 defines a first upstream edge 93 of the first air inlet 80 for that particular dryer nozzle. Each lateral plate 92 is also generally horizontal, as shown in FIG. 4.

As the leading edge of the sheet 70 continues upstream in direction of arrow 90, it passes the first air inlet 80 of each dryer nozzle and is then moved past a baffle plate 94 on each dryer nozzle. Each baffle plate 94 has a generally planar smooth surface 96 facing the sheet drying path with a first upstream lateral edge 98 of the surface 96 defining a second downstream edge 100 of the first air inlet slot 80. A second downstream lateral edge 102 of the surface 96 defines a first upstream edge 104 of the second air inlet slot 82. As seen in FIG. 4, surface 96 of the baffle plate 94 is slightly spaced from and tilted with respect to the generally horizontal sheet drying path for the sheet 70. The first lateral edge 98 of the surface 96 is farther from the sheet drying path then the second lateral edge 102 of the surface 96.

As the sheet of photosensitive material 70 moves in direction of arrow 90 past the baffle plate 94 and second air inlet 82, it encounters a plurality of generally parallel longitudinally extending fingers 110. The fingers 110 are guide means for guiding the sheet 70 along the sheet drying path and toward the next downstream roller pair 32. Each finger 110 has a first end 112 and a second end 114, with the first end 112 being upstream, relative to the longitudinal direction of movement of the sheet 70 along the sheet drying path, from the second end 114. Each finger 110 has a tilted edge 111 facing the sheet drying path to define a sheet guide ramp with its first upstream end 112 further from the sheet drying path than its second downstream end 114, as seen in FIG. 4.

Preferably, the plurality of fingers 110 are formed of plastic in a unitary fashion, with the fingers 110 being connected by a support block 116 which is secured to a wall of the dryer duct 42 or 44 adjacent the second air inlet 82.

The fingers 110 are spaced laterally across an air outlet 120 for each dryer nozzle 42 or 44. Air which is blown toward the sheet drying path through air inlets 80 and 82 thus escapes away from the sheet drying path through the air outlet 120. As seen in FIG. 4, air outlets 120 is downstream from the air inlets 80 and 82. The air outlet for each dryer nozzle is, as shown, proximate the next downstream roller pair 32 in the dryer portion 28 (such as rollers 32*a*″ and 32*b*″ in FIG. 4), with respect to the direction of movement of the sheet 70.

The first end 112 of each finger 110 (and portions of the support block 116) define a second downstream edge of the second air inlet slot 82. The first end 112 of each finger 110 is further from the sheet drying path than the second lateral edge 102 of the surface 96 of the baffle plate 94. Thus, for both of the air inlets 80 and 82, the first lateral edge of each air inlet (which is upstream relative to the direction of sheet movement) is closer to the sheet drying path than the second lateral edge of that air inlet. This design feature, along with the inclined surface 96 and sheet guide ramps defined by the edges 111 of the fingers 110 all provide means for supporting and guiding a leading edge of the sheet 70 as it passes between longitudinally spaced roller pairs 32. This design also serves to direct dryer air flow in a downstream fashion to minimize air turbulence. Photosensitive sheets 70 (which are usually unique, one-of-a-kind items) can have a tendency to curl as processed and these features thus engage the leading edge thereof and discourage curling of the sheet 70 away from the sheet drying path and out of engagement with roller pairs 32. In fact, the sheet guide ramps defined by the fingers 110 are specifically designed to "feed" the leading edge of the sheet 70 into the next downstream roller pair 32 (rollers 32*a*″ and 32*b*″) after that edge of the sheet 70 has passed by the opposed dryer nozzles 42 and 44.

The sheet guide ramps defined by the fingers 110 thus provide means for guiding the sheet of photosensitive material 70 along the sheet drying path and toward the next downstream pair of drive rollers while creating no obstruction to the air flow between the air inlets 80 and 82 of each dryer nozzle and the sheet of photosensitive material 70 in the sheet drying path. With this unique arrangement, rollers 32*a* and 32*b* of one inch diameter can be spaced apart longitudinally on center preferably 3.5 inches. To achieve this relative spacing of rollers in prior art dryer schemes required supports between the rollers (such as support wires) to prevent the sheet of photosensitive material from curling away from engagement with the next downstream pair of rollers. With the unique dryer nozzle design of the present invention, however, the sheet is guided into correct engagement with the roller pairs and the dryer portion of the processor without any obstruction (such as guide wires or other supports) between the sheet and the air inlets of the dryer nozzles. This allows the drying of the sheet with minimal turbulence and smooth airflow from the dryer nozzle to the sheet and then away from the sheet through the air outlets. Such smooth airflow permits the drying of the sheets without the creation of reflective artifacts thereon, thereby creating a more visibly desirable sheet of photosensitive material after processing.

Although the present invention has been described with reference to preferred embodiments, workers skilled in the art will recognize that changes may be made in form and detail without departing from the spirit and scope of the invention.

What is claimed is:

1. A dryer apparatus for drying sheets of photosensitive material which comprises:

a plurality of pairs of opposed drive rollers for supporting a sheet of photosensitive material in a generally planar sheet drying path including an upstream pair of opposed drive rollers and at least one downstream pair of opposed drive rollers, with, each pair of opposed drive rollers being spaced longitudinally along the sheet drying path;

drive means for selectively rotating the drive rollers to move the sheet of photosensitive material in a first longitudinal direction along the sheet drying path;

a plurality of pairs of opposed dryer nozzles facing the sheet drying path from each planar side thereof, each pair of opposed dryer nozzles being between adjacent longitudinally spaced pairs of drive rollers and each dryer nozzle including at least one laterally disposed air inlet;

blower means for blowing air through the air inlet of each dryer nozzle toward the sheet of photosensitive material; and guide means for guiding the sheet of photosensitive material along the sheet drying path and toward each downstream pair of drive rollers, and the guide means having no obstruction to air flow from the air inlets of the dryer nozzles to the sheet of photosensitive material in the sheet drying path between adjacent pairs of opposed drive rollers to permit air from the blower means to flow longitudinally along each planar side of the sheet of photosensitive matarial in a non-turbulent fashion.

2. The dryer apparatus of claim 1 wherein each dryer nozzle has an air outlet downstream, relative to the first longitudinal direction of movement of the sheet of photosensitive material along the sheet drying path, from the air inlet of said dryer nozzle and wherein the sheet of photosensitive material is engaged and guided by the guide menas only adjacent the air outlet of each dryer nozzle.

3. The dryer apparatus of claim 2 wherein the air outlet of each dryer nozzle is proximate a next downstream drive roller.

4. A dryer apparatus for drying sheets of photosensitive material which comprises:

a plurality of pairs of opposed drive rollers for supporting a sheet of photosensitive material in a generally planar sheet drying path, each pair of opposed drive rollers being spaced longitudinally along the sheet drying path;

drive means for selectively rotating the drive rollers to move the sheet of photosensitive material in a first longitudinal direction along the sheet drying path;

a plurality of pairs of opposed dryer nozzle facing the sheet drying path from each planar side thereof, each pair of opposed dryer nozzle being between adjacent longitudinally spaced pairs of drive rollers and each dryer nozzle including at least one laterally disposed air inlet;

blower means for blowing air through the air inlet of each dryer nozzle toward the sheet of photosensitive material; and guide means for guiding the sheet of photosensitive material along the sheet drying path and toward selected pairs of drive rollers, the guide means including a plurality of generally parallel longitudinally extending fingers spaced laterally across a portion of each dryer nozzle, each finger having a first end and a second end with the first end being upstream, relative to the first longitudinal direction of movement of the sheet of photosensitive material along the sheet drying path, from the second end, and each finger defining a sheet guide ramp with its upstream end further from the sheet drying path than its downstream end and having no obstruction to air flow from the air inlets of the dryer nozzles to the sheet of photosensitive material in the sheet drying path between adjacent pairs of opposed drive rollers.

5. The dryer apparatus of claim 1 wherein each air inlet is a lateral air inlet slot in its respective dryer nozzle.

6. The dryer apparatus of claim 5 wherein a first lateral edge of each air inlet slot is closer to the sheet drying path than a second lateral edge of that air inlet slot, with the first end of the slot being upstream, relative to the first longitudinal direction of movement of the sheet of photosensitive material along the sheet drying path, from the second end of the slot.

7. A dryer comprising for drying sheets of photosensitive material which comprises:

a plurality of pairs of opposed drive rollers for supporting a sheet of photosensitive material in a generally planar sheet drying path, each pair of opposed drive rollers being spaced longitudinally along the sheet drying path;

drive means for selectively rotating the drive rollers to move the sheet of photosensitive material in a first longitudinal direction along the sheet Y drying path;

a plurality of opposed dryer nozzles facing the sheet drying path from each planar side thereof, each pair of opposed dryer nozzle being between adjacent longitudinally spaced pairs of drive rollers and each dryer nozzle having first and second air inlet slots which are generally parallel and laterally disposed relative to the sheet drying path, the first lateral edge of each air inlet slot being closer to the sheet drying path than a second lateral edge of that air inlet slot, with the first end of the slot being upstream, relative to the first longitudinal direction of movement of the sheet of photosensitive material along the sheet drying path, from the second end of the slot with baffle means between the first and second air inlet slots of each dryer nozzle, the baffle means having a generally planar, smooth surface facing the sheet drying path with a first lateral edge of the surface defining the second edge of the first air inlet slot and a second lateral edge of the surface defining the first edge of the second air inlet slot;

blower means for blowing air through the air inlet of each dryer nozzle toward the sheet of photosensitive material; and guide means for guiding the sheet of photosensitive material along the sheet drying path and toward each pair of drive rollers and having no obstruction to air flow from the air inlets of the dryer nozzles to the sheet of photosensitive material in the sheet drying path between adjacent pairs of opposed drive rollers.

8. The dryer apparatus of claim 7 wherein the smooth surface of the baffle means is inclined with its first edge further from the sheet drying path than its second edge.

9. The dryer apparatus of claim 1, and further comprising:

means for permitting one of the drive rollers of each pair of opposed drive rollers to move toward and away from the other drive roller of said pair.

10. The dryer apparatus of claim 1 wherein the guide means has no contact with the sheet of photosensitive material in the sheet drying path between opposed pairs of dryer nozzles.

11. A dryer apparatus for drying sheets of photosensitive material which comprises:

(a) a housing (b) a plurality of spaced apart, generally parallel upper drive rollers rotatably mounted with respect to the housing;

(c) a plurality of spaced apart, generally parallel lower drive rollers rotatably mounted with respect to the housing, each lower roller being aligned under a respective upper roller to define a photosensitive sheet path therebetween; (d) drive means for rotating the rollers to move a sheet of photosensitive material in a first downstream direction along the photosensitive sheet path;

(e) an upper dryer nozzle between adjacent upper drive rollers having a plurality of upstream air inlets, wherein no obstruction to air flow from said air inlets to the photosensitive sheet exists between adjacent upper drive rollers, and further including at least one downstream air outlet adjacent thereto;

(f) a lower dryer nozzle between adjacent lower drive rollers having a plurality of upstream air inlets, wherein no obstruction from said air inlets to the photosensitive sheet exists between adjacent lower drive rollers, and further including at least one downstream air outlet adjacent thereto;

(g) blower means for blowing air through the air inlets of the dryer nozzles toward the photosensitive sheet path;

(h) a plurality of generally parallel upper fingers extending over the air outlet immediately upstream of each upper drive roller, each finger defining an upper sheet guide ramp with its upstream end further from the photosensitive sheet path than its downstream end; and (i) a plurality of generally parallel lower fingers extending over the air outlet immediately upstream of each lower drive roller, each finger defining a lower sheet guide ramp with its upstream end further from the photosensitive sheet path than its downstream end.

12. The dryer apparatus of claim 11 wherein each air inlet is defined as a slot in its respective dryer nozzle which extends generally parallel to the photosensitive sheet path and generally perpendicular to a direction of sheet movement.

13. The dryer apparatus of claim 12 wherein an upstream edge of each air inlet slot is closer to the photosensitive sheet path than a downstream edge of that air inlet slot.

14. The dryer apparatus of claim 13 wherein the downstream edge of one of the air inlet slots is the upstream end of the fingers adjacent the next downstream drive roller.

15. The dryer apparatus of claim 12 wherein each dryer nozzle has a first upstream air inlet and a second downstream air inlet, and further comprising:

baffle means between the first and second air inlets, the baffle means having a generally planar, smooth surface facing the photosensitive sheet path with a first upstream edge of the surface defining the downstream edge of the first air inlet and a second downstream edge of the surface defining the upstream edge of the second air inlet.

16. The dryer apparatus of claim 15 wherein the smooth surface of the baffle means is inclined with its upstream edge further from the photosensitive sheet path than its downstream edge.

17. The dryer apparatus of claim 11, and further comprising:

means for permitting each upper drive roller to move toward and away from its respective lower drive roller.

18. A method for drying sheets of photosensitive material which comprises the steps of:

(a) supporting a sheet of photosensitive material on a generally planar sheet drying path defined between each opposed rollers of a plurality of spaced pairs of rollers;

(b) rotating the opposed rollers of the roller pairs to move the sheet along the sheet drying path;

(c) blowing air from opposed air inlets between adjacent spaced roller pairs toward opposite sides of the sheet on the sheet drying path;

(d) eliminating all obstructions to air flow from each air inlet to the sheet in the sheet drying path between adjacent spaced roller pairs to permit air flow in a smooth, non-turbulent manner longitudinally along the opposed sides of the sheet in the sheet drying path.

19. The method of claim 18, wherein the sheet is moved along the sheet drying path in a first longitudinal direction and further comprising the step of:

directing the blown air away from the sheet drying path through an air outlet spaced longitudinally downstream, relative to the first direction of sheet movement, from the air inlet.

20. The method of claim 18, and further comprising the step of:

providing sheet guide means adjacent each air outlet for guiding the sheet toward opposed rollers without creating any air flow obstructions between the air inlet and the sheet drying path.

21. The method of claim 18, and further comprising the step of:

providing sheet guide means immediately upstream from selected roller pairs for guiding the sheet toward opposed rollers without creating any air flow obstructions between the air inlet and the sheet drying path.

* * * * *

UNITED STATES PATENT AND TRADEMARK OFFICE

CERTIFICATE OF CORRECTION

PATENT NO. : 4,693,014

DATED : September 15, 1987

INVENTOR(S) : Jerry A. Caflisch et al.

It is certified that error appears in the above-identified patent and that said Letters Patent is hereby corrected as shown below:

Column 7, line 55, delete "menas" and insert —means--.

Column 8, line 3, delete "nozzle" and insert --nozzles--.

Column 8, line 39, delete "comprising" and insert --apparatus--.

Column 8, line 48, after the word "sheet", delete the letter "Y".

Column 8, line 52, delete "nozzle" and insert —nozzles—.

Signed and Sealed this

Thirty-first Day of October, 1989

*Attest:*

*Attesting Officer*

DONALD J. QUIGG

*Commissioner of Patents and Trademarks*